US008292541B2

(12) United States Patent
Akkala

(10) Patent No.: US 8,292,541 B2
(45) Date of Patent: Oct. 23, 2012

(54) TRENCH GRATE ASSEMBLY WITH DEBRIS CHUTE

(75) Inventor: Steven M. Akkala, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 268 days.

(21) Appl. No.: 12/030,591

(22) Filed: Feb. 13, 2008

(65) Prior Publication Data

US 2008/0193217 A1 Aug. 14, 2008

Related U.S. Application Data

(60) Provisional application No. 60/889,687, filed on Feb. 13, 2007.

(51) Int. Cl.
*E02B 5/08* (2006.01)

(52) U.S. Cl. ..... 405/43; 210/164; 404/2; 405/119

(58) Field of Classification Search ..... 405/36, 405/43, 118, 119; 210/163, 164; 404/2
See application file for complete search history.

(56) References Cited

U.S. PATENT DOCUMENTS 2,843,913 A 7/1958 Barron
2,917,804 A 12/1959 Barron
3,225,545 A * 12/1965 Flegel ..... 405/43
3,263,579 A * 8/1966 Dorris ..... 404/26
4,472,078 A * 9/1984 Karbstein ..... 404/2
4,553,874 A 11/1985 Thomann et al.
4,640,643 A 2/1987 Williams
4,787,773 A 11/1988 Kehler
4,844,655 A 7/1989 Aleshire
4,993,877 A 2/1991 Beamer
4,993,878 A 2/1991 Beamer
5,052,654 A 10/1991 Means et al.
5,066,165 A 11/1991 Wofford et al.
5,613,804 A * 3/1997 Beamer ..... 405/119
7,048,466 B2 * 5/2006 Benesteau et al. ..... 404/4
2008/0193217 A1 * 8/2008 Akkala ..... 405/43

* cited by examiner

*Primary Examiner* — Tara Mayo-Pinnock

(74) *Attorney, Agent, or Firm* — Krieg DeVault LLP

(57) ABSTRACT

A frame for retaining a grate over a trench for directing storm water to subterranean basins includes a frame that is embedded in the concrete surrounding the trench. The frame includes a vertical support that is sized and dimensioned to abut the pavement wall of the trench, and a horizontal flange extending from the vertical support to support a grate. The horizontal flange and grate each include a plurality of apertures that are configured to be aligned to receive coupling devices for securing the grate to the frame. A chute is positioned beneath each aperture in the frame to direct debris from the aperture to the trench.

20 Claims, 3 Drawing Sheets

TRENCH GRATE ASSEMBLY WITH DEBRIS CHUTE

CROSS-REFERENCE TO RELATED APPLICATION

This application claims the benefit of U.S. Provisional patent application Ser. No. 60/889,687 filed on Feb. 13, 2007 and entitled "Trench Grate Assembly With Debris Chute."

FIELD OF THE INVENTION

The present invention is directed to a grate assembly for topping a drainage trench, and more specifically, to a frame for supporting and retaining a grate structure over a drainage trench.

BACKGROUND OF THE INVENTION

Trenches for directing storm water to subterranean piping are commonly found in paved surfaces such as driveways and parking lots, and are typically found across vehicular entrances and interior surfaces of the pavement. To allow for vehicular travel over the trench, these trenches are typically covered by substantial grates or grating systems and assemblies that are cast into the pavement, for example, concrete.

Typical trench grate assemblies include two parts: a frame section that is cast into and retained by the pavement, and a grate section. The frame section comprises a metal component that is positioned over a ledge formed in the pavement when it is cast around the frame along the sides of the trench and is sized and dimensioned to receive a grate, that is usually generally rectangular in shape. The frame can be made up of many frame sections connected end to end to receive many grate sections end to end, so the trench can be quite long. The grate sections are typically fastened to the frame using bolts that extend through holes in the grate sections and are screwed into threaded holes in the frame.

Prior grates were sometimes difficult to attach securely to the frame. The threaded holes in the frame were blind holes or if through holes were closed by the concrete or other pavement into which the frame was cast. Debris could collect in the holes and when a bolt being threaded into the hole contacts debris proper tightening of the bolt becomes impossible. Once compressed, the debris could be difficult to remove and so fasteners could be left out or not completely tightened, resulting in a structure less structurally sound than intended, and would allow grates to be easily dislodged by traffic. The present invention addresses these problems.

SUMMARY OF THE INVENTION

In one aspect, the present invention provides a frame for retaining a trench grate over a drainage trench. The frame includes a substantially vertical support member having a sidewall for alignment along a wall of the drainage trench pavement into which the frame is cast, and a bearing flange extending substantially perpendicular to the sidewall for supporting a grate over the drainage trench, the bearing flange overlying the drainage trench pavement into which the frame is cast. The bearing flange includes at least one aperture for receiving a fastener for coupling the grate to the bearing flange, and a chute that substantially circumscribes an area below the aperture and that includes an opening directed inward toward the trench to direct debris collected through the aperture toward the trench to maintain the aperture in an open condition.

In another aspect of the invention, the chute can be angled toward the trench, and can also substantially circumscribe an area below the aperture. The interior of the chute, moreover, can be formed in the shape of compartment open at its front and closed on all other sides except the top into which the fastener hole opens.

The chute may, for example, be generally in the shape of a quarter sphere. The frame can also include an anchor element extending from a corner formed between the substantially vertical support member and the bearing flange in a direction away from the trench and into the pavement, to be cast and therefore securely retained in the pavement. The anchor member can include an aperture sized and dimensioned to have a rebar reinforcement rod threaded through it, which is also cast into the pavement for additional securement.

In yet another aspect of the invention, a frame for retaining a trench grate over a drainage trench is provided, including a support member extending along a wall of the drainage trench and including a substantially vertical sidewall. A substantially horizontal flange extends from the sidewall of the support member for supporting a grate in the drainage trench. Pavement encapsulates the outer side and bottom surfaces of the support member. A chute extends downward from the support member and is positioned below and substantially surrounding the aperture, which prevents pavement from filling in beneath the hole when the pavement is cast. A side of the chute faces inwardly toward the trench and includes an opening to allow debris received in the chute to be directed into the trench and to prevent debris from gathering in the bottom of the threaded hole. The opening in the chute can include a lower edge that is angled toward the trench.

In still another aspect of the invention, a drainage trench is provided, comprising a concrete structure having a bottom surface and first and second substantially parallel sidewalls, with shoulders at the upper ends of the sidewalls. A frame is embedded in the shoulders and includes a vertical support aligned along a side of each of the first and second parallel sidewalls and a substantially horizontal bearing flange extending from each of the vertical supports toward a center of the pavement trench. A grate, including a first plurality of spaced apertures, is received in the frame. A second plurality of spaced apertures is formed in the substantially horizontal bearing flange of the frame, and is configured for alignment with the first plurality of apertures for receiving fasteners to couple the grate to the frame. A chute is formed below each set of aligned apertures that has outer surfaces of its rear, side and bottom walls embedded in the pavement. Each chute includes an opening in its front wall, facing the trench, wherein debris collected in the aligned apertures can fall through the apertures into the chute and through the opening to maintain the apertures open. The inward edge of the opening is preferably in a plane and the plane is coplanar with the inward facing surface of the bearing flange to be sealed by a planar concrete form when concrete is poured around the frame. The chute can be ramped in the direction of the trench, substantially rounded in configuration, or can be shaped substantially as a quarter sphere.

Features and characteristics of the present invention will be apparent from the description which follows. In the detailed description below, preferred embodiments of the invention will be described with reference to the accompanying drawings. These embodiments do not represent the full scope of the invention. Rather the invention may be employed in other embodiments, and reference should therefore be made to the claims herein to determine the scope of the invention.

DETAILED DESCRIPTION OF THE PREFERRED EMBODIMENT

Figure 1:
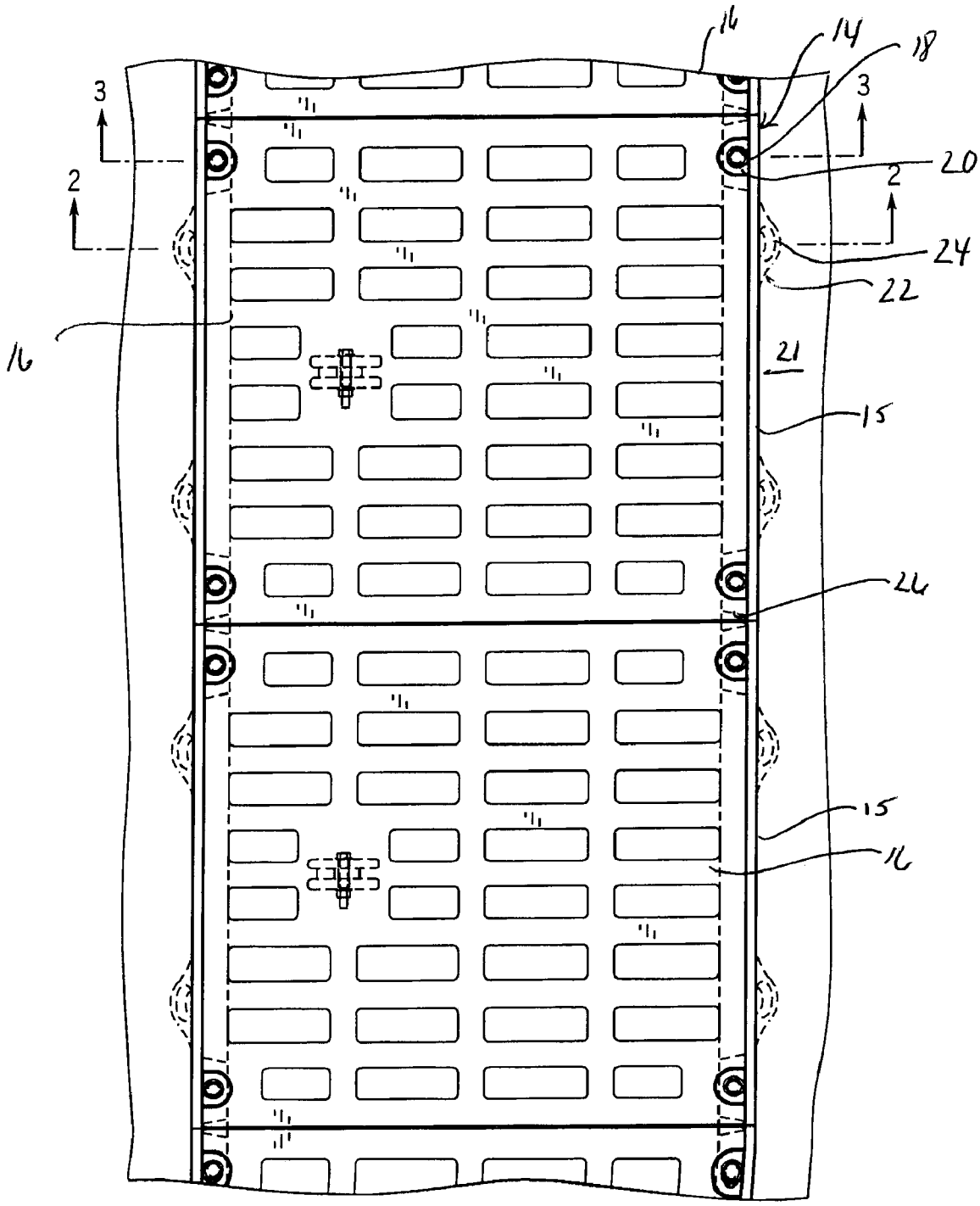
FIG. 1 is a top view of a trench assembly including a frame constructed in accordance with the present invention assembled as part of a drainage trench.

Referring now to the Figures and more particularly to FIG. 1, a top view of a trench grate assembly 10 constructed in accordance with the present invention is shown, as assembled over a drainage trench. The trench grate assembly 10 generally comprises a frame 14, constructed from a plurality of frame sections 15 laid end to end, and a plurality of grate sections 16 that are received in the frame 14. The frame 14 is constructed by aligning frame sections 15 end to end along a concrete form, e.g., sheets of plywood assembled so they create an open topped box, with the front or inward surfaces of the sections 15 against the outer sides of the concrete form, and pouring concrete around the sides of the form and the outside surfaces of the frame sections 15. The concrete form, made of flat sheets, for example plywood, lays up flat against the front (or inward) surfaces 32 and 49 of the respective chute 26 and bearing flange 28, which surfaces are flush with one another so as to simultaneously seat against the flat surface. This prevents concrete from flowing into the chute 26 or up over the flange 28. The form, of course, prevents the concrete from flowing into the form so that when the concrete sets, the form can be removed leaving the open trench bordered at its top margin by the frame sections 15, with the concrete side walls 51 of the trench substantially flush with the inward surfaces 32 and 49 of the respective chute 26 and flange 28.

Anchors 22 are embedded in the pavement 21 surrounding the trench 12, and may have steel re-bar threaded through them. The re-bar can be bent in a U or V shape, and the re-bar cast into the concrete along with the anchors 22 for additional holding force. The grate sections 16 are aligned end to end over the drainage trench 12 in the frame 14, and each includes a plurality of threaded apertures 20, which receive fasteners 18 in threaded engagement, for retaining the grate sections 16 on the frame 14. Each fastener 18 is positioned over a debris chute 26, a portion of the frame 15 that maintains an open area beneath the aperture 20 and fastener 18, and directs debris from the bolt hole 23 toward the trench 12.

Figure 2:
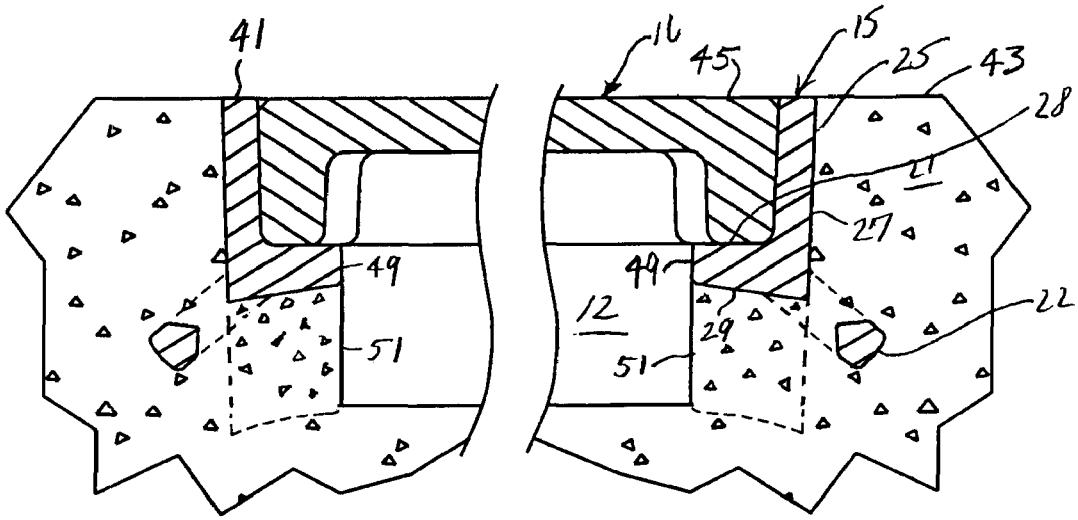
FIG. 2 is a cutaway side view of the trench assembly taken along the line 2-2 of FIG. 1.

Referring now to FIG. 2, a cutaway side view of the trench grate assembly 10 of FIG. 1 taken along line 2-2 is shown. The frame sections 15 each include a substantially vertical member 25 coupled integrally (i.e., cast in one piece) to a horizontal flange 28 that extends along the length of the frame section 15. A top surface 41 of the vertical member 25 aligns substantially with the top or roadway surface 43 of the pavement 21, and the outside 27 and bottom 29 surfaces of the section 15 are cast in the concrete or other pavement. The bottom surface 29 is preferably angled downwardly away from the trench so that when the section 15 is driven over, it tends to wedge into the corner formed by the surrounding concrete. The generally horizontal flange 28 is positioned a distance from the top surface of the vertical member 25 selected to allow a grate section 16 to be positioned within the frame 14 with the top surface 45 of the grate section 16 substantially aligned with the top surfaces 41 and 43 of both the frame 14 and the pavement 21, to provide a substantially continuous roadway surface. Anchor members 22 extend into the pavement 21 and are angled downward and away from the corner formed by the surfaces 27 and 29. The anchor members 22 each include an aperture sized and dimensioned to receive a rebar reinforcement member, as described above.

Figure 3:
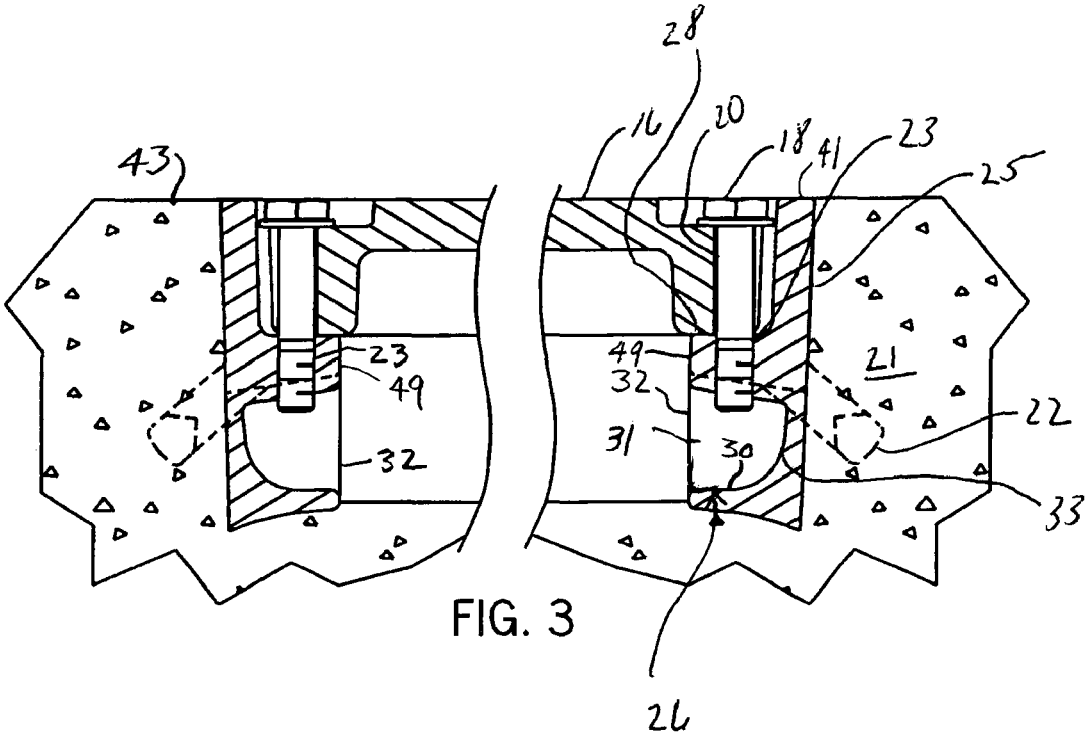
FIG. 3 is a cutaway view of the trench taken along line 3-3 of FIG. 1.
Figure 4:
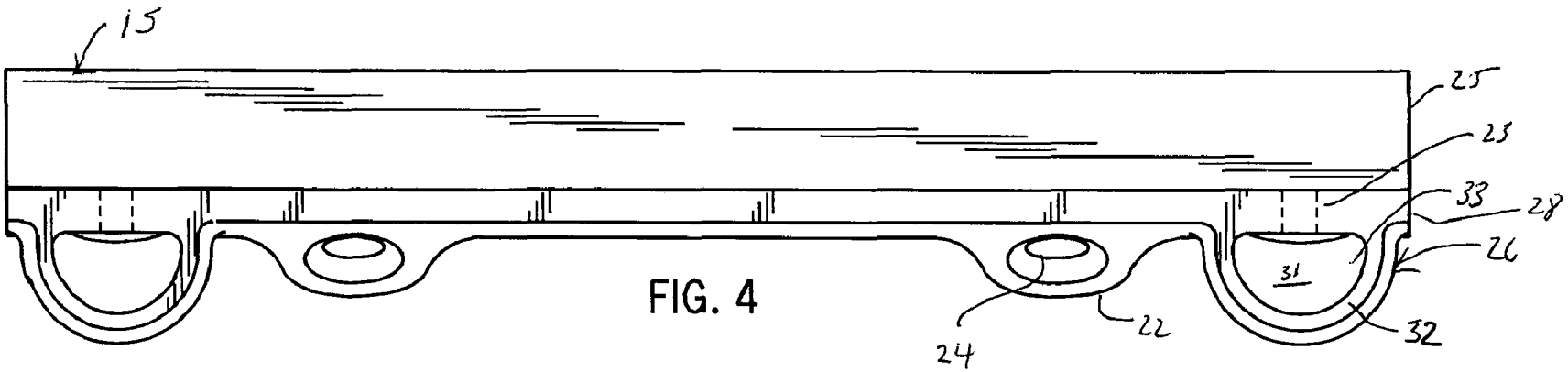
FIG. 4 is a front view of a frame section of FIG. 1.

Referring now to FIG. 3, a cross-sectional view of the trench 12 taken along the line 3-3 of FIG. 1 through the debris chute 26 in the frame section 15 is shown. The debris chute 26 is positioned adjacent an aperture 23 in the frame section 15 that is aligned with an aperture 20 in the grate section 16 for receiving a threaded fastener 18 to couple the grate section 16 to the frame section 15. The debris chute 26 is formed below the bottom surface of the horizontal flange 28 and, referring now also to FIG. 4, substantially circumscribes the aligned holes 20 and 23. An interior surface 33 of the chute 26 is directed toward an opening 31, and is substantially rounded in cross-section such that a corner between a back wall and a lower surface of the debris chute 26 is curved and sloped toward the opening 31, forcing dirt and debris collected in the debris chute 26 through the opening 31 and into the trench 12, to maintain the aperture 23 substantially open. The lip of the lower surface 30 positioned adjacent the trench 12 is also rounded, again to force dirt and debris from the chute 26. As shown here, the interior surface 33 is shaped as a compartment with a single open side, on its inward side, and the threaded bolt hole 23 opening in its top side. More particularly, the chute 26 is cupped, and may be substantially shaped as a portion of a sphere, and more specifically as a quarter of a sphere-like surface. Referring still to FIG. 4, the opening 31 of the debris chute 26, therefore, is generally a cross section of a sphere and therefore substantially semi-circular in shape, with an upper surface formed by the flange 28. Concrete or other paving material encapsulates the sides, bottom and back of the chute 26, and is not over the opening 31. Opening 31 is defined by edge surface 32 of the chute 26 around the opening 31. Surface 32 is co-planar with the vertical edge surface 49 at the front of the flange 28. Being coplanar allows these surfaces 31 and 49 to butt up against the flat side of a concrete form, typically a plywood surface, to prevent concrete from flowing into the chute 26 or up over the flange 28 when the concrete is poured. The concrete sidewalls 51 therefore are cast substantially flush, i.e. substantially co-planar at least where they meet the edges 32 and 49, with the front edges 32 and 49 of the respective chute 26 and flange 28.

Figure 5:
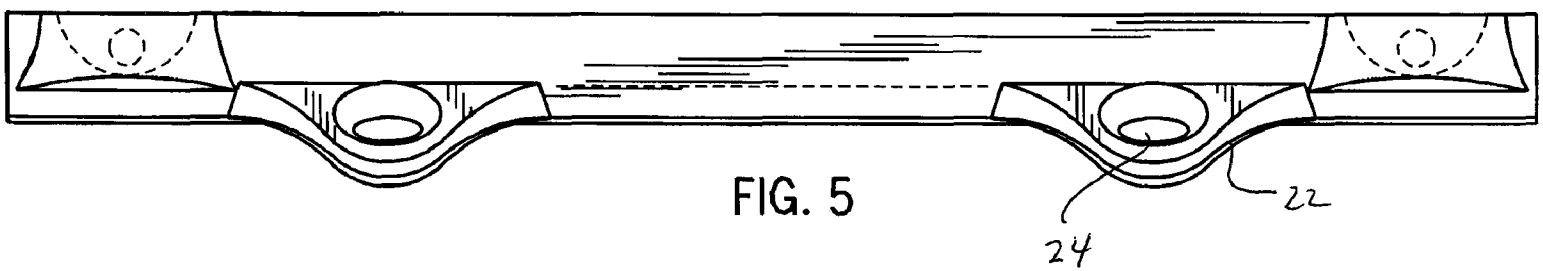
FIG. 5 is a bottom view of a frame section of FIG. 1.

Referring now to FIG. 5, a bottom view of the frame section 15 is shown. Debris chutes 26 are located adjacent apertures 23 for receiving a threaded fastener 18, and include a rounded inner surface substantially closed except at the front opening 31 and top hole 23, as described above with reference to FIGS. 4 and 5.

Referring still to FIG. 5, the frame section 15 is again shown with anchor members 22, including apertures 24 sized and dimensioned to receive a rebar reinforcement. The anchor members 22 can couple the frame to wood or other framing members during construction of the trench 12, for retaining the corresponding frame section 15 in the pavement 21 and anchoring the frame section 15 in position when they are set in cured concrete, particularly if re-bar is threaded through them.

Referring again to FIG. 3, it can be seen that, after the fastener 18 is removed from apertures 20 and 23, dirt and debris falling into the aligned apertures 20 and 23 will be directed to the debris chute 26, thereby preventing the accumulation of debris which could clog the holes 20 and 23, prevent the insertion of the fastener 18, and thereby inhibit either assembly or re-assembly of the frame and grate assembly 10.

Although a preferred embodiment of the invention has been described in considerable detail above, many modifications and variations to the preferred embodiment will be apparent to a person of ordinary skill in the art. For example, although the interior of the chute is shown and described as forming a portion of a sphere, the interior surface can be angled toward the drainage trench in various ways, and formed in various shapes useful for directing debris toward the trench. For example, the interior of the chute can be formed as a tube, or ramped or angled, toward the trench in a number of different ways which will allow debris to be directed into the trench.

Preferably, as shown in FIG. 1, an aperture 20 is provided adjacent each corner of the grate section 16 to receive a fastener 18. Various other types of locking and coupling devices, however, could also be used for securing the grate sections 16 to the frame 14. Furthermore, although the frame sections 15 are shown here as separate and independent pieces, adjacent frame sections 15 can also be coupled together. For example, adjacent frame sections can include apertures for receiving threaded or other fasteners or coupling devices.

A preferred embodiment of the invention has been described in considerable detail. Many modifications and variations will be apparent to persons skilled in the art. Therefore, the invention should not be limited to the embodiment described but should be defined by the claims that follow.

I claim:

1. A frame for retaining a trench cover over a drainage trench, the frame comprising:

a substantially vertical support member;

a bearing flange extending substantially perpendicular inwardly from the support member for supporting the cover over the drainage trench, with the cover laying on the bearing flange adjacent to the support member, the hearing flange including at least one aperture for receiving a fastener that secures the cover to the bearing flange; and a chute positioned below the aperture and including an opening directed toward the trench, wherein when the frame is installed on the drainage trench the fastener is removable from the at least one aperture and debris collected through the aperture is directed toward the trench through the chute to maintain the at least one aperture open so that the fastener can be re-positioned in the at least one aperture.

2. The frame as defined in claim 1, wherein the chute substantially circumscribes a volume below the aperture that is substantially closed except for the opening toward the trench and the aperture in the bearing flange.

3. The frame as defined in claim 1, wherein an interior of the chute is cupped to form a quarter sphere so as to direct material toward the opening.

4. The frame as defined in claim 1, wherein the interior of the chute includes a lower edge that is angled to the opening of the chute into the trench.

5. The frame as defined in claim 1, wherein a back portion of the chute is contiguous with the substantially vertical support member.

6. The frame as defined in claim 1, wherein the chute and flange have front edges that are substantially flush with one another so as to simultaneously seat against a flat surface.

7. The frame as defined in claim 1, further comprising an anchor element extending from a corner formed between the substantially vertical support member and the bearing flange in a direction away from the trench and into the pavement.

8. The frame as defined in claim 7, wherein the anchor includes an aperature sized and dimensioned to receive a rebar reinforcement.

9. A frame for retaining a trench cover over a drainage trench, the frame comprising:

a support member having a length dimension extending along a wall of the drainage trench;

a substantially horizontal flange extending from the support member for supporting the cover in the drainage trench adjacent to the support member and having a bolt hole extending through the flange and a bolt positionable in the bolt hole; and a chute extending downward from the flange and positioned below and substantially surrounding the sides and rear of the bolt hole, a front side of the chute facing the trench including an opening into the trench, wherein when the frame is installed on the drainage trench the bolt is removable from the bolt hole and debris collected through the bolt hole is directed toward the trench through the chute to maintain the bolt hole open so that the bolt can be re-positioned in the bolt hole.

10. The frame as recited in claim 9, further comprising an anchor member extending from a side of the support member opposite the substantially horizontal flange and angled in a direction away from the support member.

11. The frame as recited in claim 10, wherein the anchor member comprises an aperture for receiving a rebar reinforcement.

12. The frame as recited in claim 9, wherein the chute forms a quarter sphere with a lower edge that is angled to the opening of the chute into the trench to direct flowable material from the bolt hole toward the trench.

13. A drainage trench, comprising:

a pavement structure comprising first and second sidewalls, and a bottom surface;

a frame embedded in the pavement structure, the frame including:

at least two vertical supports spaced apart, each said support along a side of one of the first and second sidewalls of the pavement structure; and the frame including a substantially horizontal flange extending from each of the vertical supports inwardly toward a center of the concrete trench;

a grate received in the frame and including a first plurality of spaced apertures; and a second plurality of spaced apertures formed in the substantially horizontal flange of the frame and configured for alignment with the first plurality of apertures of the grate for receiving fasteners to couple the grate to the frame; and a chute formed below at least some of the aligned apertures, each chute including an opening facing the trench, wherein with the frame embedded in the pavement structure the fasteners are removable from the at least some of the aligned apertures below which the chute is formed so that debris collected through these aligned apertures is directed toward the trench through the chute to maintain these aligned apertures open so that the fasteners can be re-positioned therein.

14. The drainage trench of claim 13, wherein the frame comprises a plurality of aligned frame sections aligned along each side of the trench.

15. The drainage trench of claim 13, wherein inward edges of the flange and chute are flush with one another and with the pavement sidewall bordering the inward edges.

16. The drainage trench of claim 13, wherein the grate comprises a plurality of grate sections aligned end to end in the frame.

17. The drainage trench of claim 13, wherein each chute forms a quarter sphere and is closed except for the opening into the trench and the aperture in the flange.

18. The drainage trench of claim 13, wherein an interior surface of each chute includes a lower edge that is an led to the opening of the chute into the trench so as to direct materials from the apertures to the opening.

19. The drainage trench of claim 13, further comprising an anchor member coupled to the frame and extending into the concrete at an angle relative to the support member and flange.

20. The drainage trench of claim 19, wherein the anchor member includes an aperture for receiving a rebar reinforcement.

* * * * *